US007073633B2

(12) United States Patent
Weinberger et al.

(10) Patent No.: US 7,073,633 B2
(45) Date of Patent: Jul. 11, 2006

(54) DEVICE AND METHOD FOR REMOTE MAINTENANCE OF AN ELEVATOR

(75) Inventors: Karl Weinberger, Cham (CH); Kilian Schuster, Ballwil (CH)

(73) Assignee: Inventio AG, Hergiswil (CH)

( * ) Notice: Subject to any disclaimer, the term of this patent is extended or adjusted under 35 U.S.C. 154(b) by 222 days.

(21) Appl. No.: 10/691,950

(22) Filed: Oct. 23, 2003

(65) Prior Publication Data

US 2004/0094366 A1 May 20, 2004

(30) Foreign Application Priority Data

Oct. 29, 2002 (EP) ..... 02405919

(51) Int. Cl.
*B66B 1/34* (2006.01)

(52) U.S. Cl. ..... 187/393; 187/247

(58) Field of Classification Search ..... 187/391–394, 187/298, 299, 413, 247, 248
See application file for complete search history.

(56) References Cited

U.S. PATENT DOCUMENTS 3,973,648 A * 8/1976 Hummert et al. ..... 187/393
4,106,593 A * 8/1978 Otto et al. ..... 187/393
4,512,442 A * 4/1985 Moore et al. ..... 187/393
4,697,243 A * 9/1987 Moore et al. ..... 706/59
5,064,026 A 11/1991 Nagata et al.
5,450,478 A 9/1995 Christy et al.
5,557,546 A * 9/1996 Fukai et al. ..... 702/185
5,817,994 A * 10/1998 Fried et al. ..... 187/391

FOREIGN PATENT DOCUMENTS

| | | |
|---|---|---|
| EP | 0 252 266 | 1/1988 |
| EP | 0 987 211 | 3/2000 |
| EP | 1 249 423 | 10/2002 |
| JP | 04235881 | 8/1992 |
| JP | 06-001556 | 1/1994 |
| JP | 06171855 A * | 6/1994 |
| JP | 2000302349 | 10/2000 |
| JP | 2001341956 | 12/2001 |

* cited by examiner

*Primary Examiner*—Jonathan Salata
(74) *Attorney, Agent, or Firm*—Butzel Long

(57) ABSTRACT

A device for remote maintenance and monitoring of an elevator installation has at least one input for the detection of first signals from an elevator control and/or from a sensor, at least one output of second signals to a telecommunications network and a processor and a data memory. A set of remote maintenance functions is stored in the data memory and each of these remote maintenance functions is selectively activatable.

20 Claims, 5 Drawing Sheets

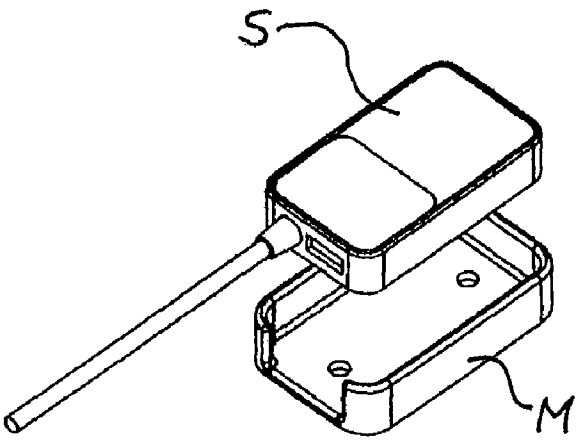
Fig. 3
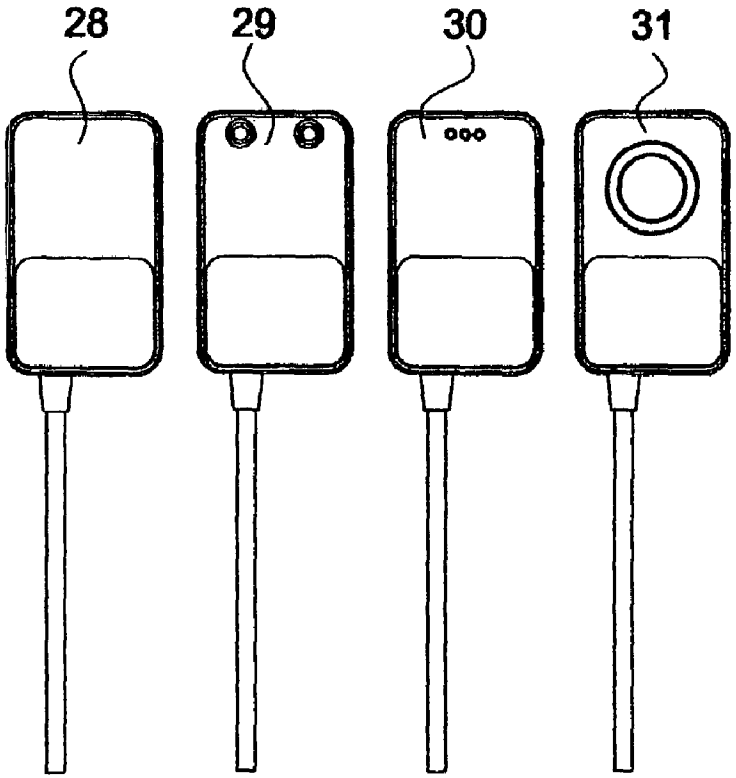

DEVICE AND METHOD FOR REMOTE MAINTENANCE OF AN ELEVATOR

BACKGROUND OF THE INVENTION

The present invention relates to an elevator and a method for remote maintenance and monitoring of an elevator installation.

For operational control there is associated with each elevator installation an elevator control with which sensors and actuators, for example control, actuating and setting elements of the elevator installation, are connected. A microprocessor of the local elevator control reads the input signals and switches the output signals in correspondence with the provided control program or regulating program. The processing of the signals and the data which are stored in the elevator control and describe the elevator installation, for example floor number, drive type, etc., is carried out in a microprocessor in situ at the elevator installation.

Elevator installations, the elevators of which are equipped with, apart from a conventional elevator control, additionally a modem for remote maintenance, are shown in the patent specifications EP 0 252 266 and U.S. Pat. No. 5,450,478. In this remote maintenance of elevator installations the elevator control of each individual elevator installation respectively communicates under specific conditions with a central service center by means of a modem via the public telecommunications network. The data exchange provided in that case primarily relates to predefined diagnostic data with respect to operational state, disturbances and alarms of all elevator installations connected with the central service center.

In this connection remote maintenance function means that diagnostic data, which concern a specific part or a function of an elevator, are transmitted to a specific service center and evaluated in the service center. A remote maintenance function can monitor, for example, the lighting in the elevator or the vibrations of the drive or the door opening. If the data are communicated only to the service center, the remote maintenance function is monodirectional. If data are also, after evaluation in the service center, communicated from the service center back to the elevator installation the remote maintenance function is bidirectional. A remote maintenance module consists of several remote maintenance functions which relate to the same part or the same function of an elevator, for example lighting or door opening. A remote maintenance system consists of an elevator installation, a service center for the remote maintenance of the elevator and the connection thereof.

A data exchange procedure, which on the one hand forms the communication path and on the other hand regulates access or access authorization to data of the elevator control, is connected upstream of the actual installation-specific data exchange depending on the respective construction and mode of function.

In this manner, elevator installations equipped with an elevator control individual to each elevator, together with modem extension and central service center have proved themselves, yet due to their constructional and functional characteristics to the extent explained they are expensive in terms of devices and only a restricted selection of predefined reports can be transferred monodirectionally to the service center. The maintenance of the individual elevator installations which are connected in the overall system with the service center and are disposed locally far apart from one another turns out to be cost intensive, since, in the case of operational disturbances of an elevator installation or an elevator, lengthy routes arise for the maintenance engineer until the cause of the disturbance is established on site and the disturbance eliminated. Long waiting times also arise in the case of operational disturbances.

These conventional remote maintenance systems for elevator installations are primarily characterized by a fixed configuration of the remote maintenance modules, which makes possibly necessary adaptations of the remote maintenance functions inconvenient and expensive. The number and kind of interfaces is predetermined and limits the flexibility in setting up the remote maintenance functions desired by customers and the market.

A high degree of flexibility of the remote maintenance modules is desired above all if an existing elevator installation is modernized by a remote maintenance system. For example, the elevator installations to be modernized often have a remote alarm system, but often not. In the case of modernization, therefore, a remote alarm function which may happen to be present has to be taken into account as part of the remote maintenance functions.

It is the object of the present invention to indicate a device and method for remote maintenance and monitoring of an elevator installation of the kind stated in the introduction which provides a high degree of flexibility in the selection and configuration of the remote maintenance functions and which proves to be economic.

SUMMARY OF THE INVENTION

The present invention concerns a device that has at least one input, to which first signals from sensors mounted at the elevator installation and/or from the elevator control are transmitted, and at least one output, by way of which connection is made to a telecommunications network. All sensors and actuators necessary for operation of an elevator installation can be connected with the device. These data are transmitted, for example, in a cable-free manner by radio or by cable-bound media, such as optical or copper conductors, etc., in a conventional manner. For example, a first signal is transmitted to an input, the device reads in this first signal and/or evaluates it and/or reworks it. The device passes on such a first signal in the form of a second signal by way of the output to the telecommunications network. In a given case, an unprocessed first signal can also be passed on to a telecommunications network. The device is at the same time capable of receiving signals from the telecommunications network and of transferring these to the elevator control as commands or data and/or of converting these.

According to the present invention a set of remote maintenance functions is stored and activatable. Preferably the set of remote maintenance functions is loaded into a data memory of the device.

The device is optionally configured for activation of a remote maintenance function, i.e. hardware and software adaptations are undertaken at the device so that the device recognizes that a first signal entering at a specific input represents, for example, the lighting of the elevator car and/or that a second signal is communicated by way of a specific output to the telecommunications network. The configuration of the remote maintenance functions is preferably undertaken by hardware and software adaptations of the device. The universality and the standardization of the electronic components which are employed enables attainment of a high degree of flexibility of the remote maintenance functions. The construction of the remote maintenance functions is modular. The remote maintenance functions can be readily extended and retrofitted. Advantageously, this adaptation of the device is carried out by way of an I/O box between the elevator installation and the device. This simple adaptation of the device by way of an interface to all kinds of elevator installations allows the unification of heterogeneous installation portfolios from the view of the service center. This means that different proprietary elevator installations can be operated, by way of the interface, with standardized remote maintenance functions.

Defined as activation of a remote maintenance function in the following is the loading of a remote maintenance function from the memory into the processor, so that the device is fully ready to undertake operations provided by a remote maintenance function.

Since the device in terms of hardware can be configured as desired in accordance with the number and kind of arriving signals, remote maintenance functions are stored, extracted, selected, activated and deactivated in a corresponding data memory as a set or software program.

Through loading of a software program into a data memory of the device one or more remote maintenance functions is or are generally added and/or removed as a set. In this case, the activation of a remote maintenance function, for example by selection of this function in a menu of the software program and loading the corresponding software into the processor, is sufficient to prepare the software program for the new remote maintenance function.

Advantageously, the maintenance functions and the programs are transmitted by way of the telecommunications network so that the transmission can take place as quickly as possible.

New remote maintenance functions can also be activated or added without interruption of the operation of the elevator installation, since the device is not absolutely necessary for normal operation of the elevator, and can take place separately from the normal operation. Advantageously, the activation of one remote maintenance function does not have the consequence of operational interruption of other remote maintenance functions, which are not affected by the activated function.

Advantages resulting therefrom consist in that the device can be easily mounted and demounted, so that the elevator installation is operable with or without remote maintenance functions. The number and kind of interfaces between device and elevator installation are variable and able to be freely configured, so that the remote maintenance functions are selected or removed.

In the case of transmission of all elevator installation data and elevator installation parameters to the service center of the overall system a central remote maintenance is possible by way of this technology. Time-intensive and wage-intensive settings and adaptations on site at the elevator are redundant or can be planned explicitly. Through modification of the software of the service center and/or of the device, elevator functions can be influenced not only for individual elevators, but also for several elevators. Moreover, it is possible to image a complete actual state of the elevator installation in the service center and to correct data, which relates to rights of use, travel destinations, etc., at the central point.

Beyond that, completely new forms of elevator installation monitoring, preventative remote maintenance and servicing are possible with the device according to the invention. Apart from the control algorithms, a separate evaluation of transmitter signals is carried out for wear and failure analysis. Each subassembly is subject to preventative analysis and statistical evaluation. Data with respect to the installation can be made available to customers in any desired form (for example, Internet pages instead of lobby PC).

Advantageously the device is concealed, dissimulated and placed out of sight for engineers/users so that unauthorized and outside persons cannot sabotage, manipulate or remotely control the elevator installation.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 3 is a plan view of several different sensors and an exploded perspective view of one sensor and a mount used in the elevator installation shown in FIG. 1;

DESCRIPTION OF THE PREFERRED EMBODIMENT

Figure 1:
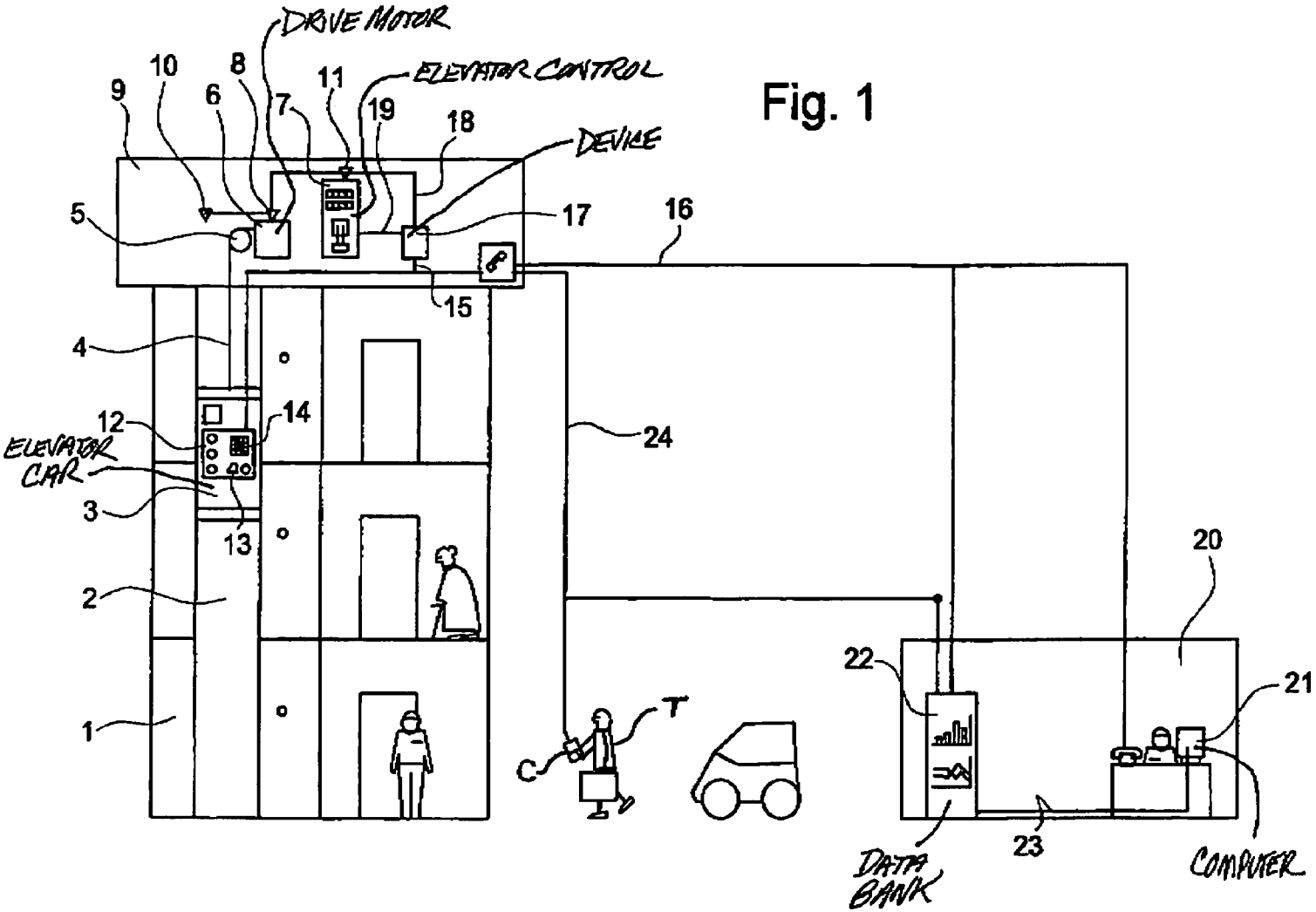
FIG. 1 is a schematic illustration of an elevator installation remotely controlled by a device for remote maintenance according to the present invention.

An elevator installation, which has an elevator car 3 movable in a shaft 2, is denoted by 1 in FIG. 1. The elevator installation 1 can be, as in this example of a first embodiment, a single elevator or also, however, an installation with several elevators, which are linked into a group in terms of control, in a building. The elevator car 3 is suspended at cables 4 guided over a drive pulley 5. The drive pulley 5 is set in motion by means of the drive motor 6, which is supplied with electrical energy by way of an elevator control 7. For monitoring the movement of the drive pulley 5 and thus the position of the elevator car 3 in the shaft 2 there is provided, for example, a position sensor 8. A temperature sensor 10 is also disposed in a machine room 9, for example at the drive motor 6. A current sensor 11 measures, for example, a current flowing in the elevator control 7. A car control panel 12, by way of which the travel destinations are registered, is arranged in the elevator car 3 according to FIG. 1. An alarm button 13 and a microphone 14 and/or a loudspeaker, which are connected by a cable with a telecommunications network 16, are arranged in the control panel.

An essential feature of the present invention is a device for remote maintenance 17 connected by an output 15 with the telecommunications network 16, which collects and processes the signals generated by the sensors 8, 10 and 11 and transmitted through an input 18. The device 17 also directly receives serial signals of the elevator control 7 through a serial connection 19 with the elevator control. In the case of the described embodiment the elevator installation 1 and a service center 20 are connected together by way of the telecommunications network 16, which represents the public telephone network. With knowledge of the present invention the expert can obviously also realize other forms of connection between the device 17 and elevator control 7, such as, for example, a parallel connection. The device 17 is implemented as a programmed conventional processor and data memory.

In a preferred embodiment an I/O box, which is not shown in FIG. 1, is introduced as an interface between the device 17 and the elevator installation and converts the parallel signals, which arrive from the elevator control 7, the elevator car 3, the elevator shaft 2 and the machine room 9, into serial signals so that they can then be serially transmitted by a bus to the device 17. The I/O box has several inputs for parallel signals. Each input corresponds with a specific signal and is connected with the corresponding cable led from the elevator installation 1. The output of the I/O box is typically a USB plug, with which a bus is connected, which communicates the data to the device 17.

A large number of cables of the elevator installation 1 must be connected in orderly and secure manner to the corresponding inputs and outputs of the I/O box, which requires use of marking systems of these inputs and outputs. The central cable channel is characteristic for the cable feed. These fed cables are divided up by way of the marking and guidance logic in the I/O box into input and output channels as well as a logical, physical region for the safety circuit. The cable guide in the I/O box also provides tension-relaxing geometries for tension relief and support surfaces where the cables rest, in order to avoid breakage.

For each input of the I/O box there can be provided an LED, the flashing of which confirms whether or not the input functions correctly and enables a quick visual check of the functionality of the I/O box or the actual state of the entire elevator system. A temperature sensor is preferably provided in the I/O box in order to avoid heat damage.

Preferably the device 17 during placing in commission automatically configures itself and is self-learning with respect to which input of the I/O box corresponds with which signal. A learning travel of the elevator car 3 from the bottom to the top of the shaft 2 is, for example, effected. During the travel the device 17 measures the signals arriving from the inputs of the I/O box and can thereby allocate the corresponding physical signal of the elevator installation 1 to each input. The device 17 also executes a plausibility test of the allocation of the signals to the inputs of the I/O box. Thus, logic faults in the wiring of the I/O box are automatically recognized and made known and can thus be simply and quickly corrected. During the learning travel the device 17 automatically recognizes the number of the floor in the building, the type of elevator door and the elevator drive, as well as other important attributes of the elevator installation 1.

The device 17 does not necessarily have to be directly connected with an I/O box or an elevator installation, but can also be connected with a further device 17 by a bus, whereby a hub function is realized. This modular concept allows the expert, with knowledge of the present invention, substantial possibilities of extension of the device.

The device 17 can also adopt the form of an intelligent cable or an intelligent plug. It is, as far as possible, economic and small and able to be retrofitted, mounted and demounted in simple manner. For that purpose the service center 20 is connected by way of data transmission equipment with all elevators of one or more installation systems. Elevator data and parameters are communicated between each elevator installation and the service center. The inputs of the device 17 are, for example, connected by USB plugs (Universal Serial Bus) and field bus with the cables which transmit the signals generated by the elevator installation.

FIG. 1 shows the service center 20 which regulates operation of the elevator installation 1 and monitors and records the serviceability state of the elevator installation. The service center 20 is composed of a computer system 21 and of a data bank 22 in which data relevant to serviceability state and operational state are filed. The computer system 21 and the data bank 22 are connected by way of a data bus 23. The data filed in the data bank 22 and/or actual operating data of the elevator installation 1 can be called up by way of the data bus 23 with the help of additional data processing equipment and be further processed for additional evaluation.

The transmitted items of information are processed in the service center 20 in the computer system 21. The computer system 21 derives from the received data also the setting commands for operation of a plurality of the installations 1. These setting commands are then transmitted from the service center 20 to the elevator installations 1 with the help of the device 17. The device 17 passes on the setting commands to each associated elevator installation 1. The device 17 controls the setting elements or actuators, such as, for example, the drive motor 6 or indicating devices.

Unusual states, which are detected by the device 17, of the elevator installation can be reported directly to the service center 20. The service center 20 is so organized that immediately after a disturbance report it distributes a request to a maintenance technician, belonging to a network, according to capability and/or availability so that the elevator installation 1 is repaired as soon as possible. Thus, a diagnostic system is integrated which, as an expert system, enables an effective and efficient problem rectification as well as maintenance of the elevator installation 1.

In the case of the described embodiment the elevator installations 1 and the service center 20 can also be connected together by way of a public mobile telecommunications network 24. In this case a GSM (Global System for Mobile communications) modem and a GSM SIM card are provided in the device 17 to provide mobile telecommunication. The software of the GSM card is preferably equipped with coding systems in order to protect against misuse. The mobile telecommunication managed by the device 17 enables, for example, a technician T to be able to carry out checking and diagnosis of the functionality of the elevator installation by a mobile communications apparatus C such as a mobile telephone, GSM or laptop computer ahead of personal presence in the building with the elevator installation.

The device 17 can be connected by the telecommunications network 16 or 24 with the Ethernet or FireWire and thus remotely monitored and remotely programmed.

Figure 2:
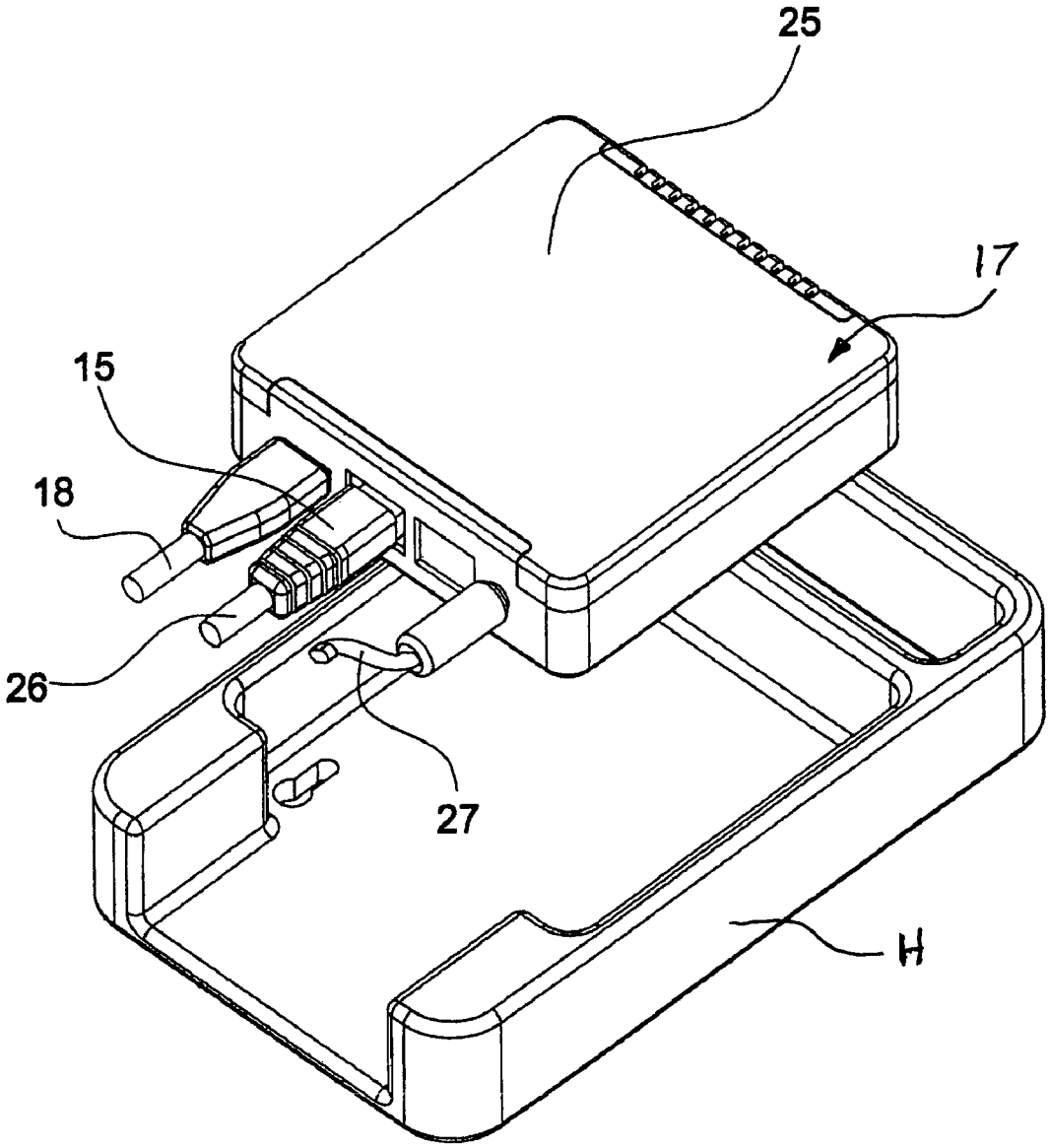
FIG. 2 is an exploded perspective view of a first embodiment of the device shown in FIG. 1.

FIG. 2 is a perspective view of a first embodiment of the device 17 shown in FIG. 1. An I/O box 25 serves as housing and acts as a cover containing the processor (CPU, Central Processing Unit) and the data memory 17. The input 18 of the box 25 consists of a sensor bus, for example a USB (Universal Serial Bus), which transmits the signals generated by the sensors (8, 10, 11) shown in FIG. 1. The output 15 of the box 25 consists of a telecommunications bus 26, for example RJ45, which communicates signals to a telecommunications network. The necessary electrical energy is supplied, for example, by a mains plug part 27. A further output (not shown) enables direct access to the CPU and to the data memory of the box 25 by a PC. A further input (not shown) communicates serial signals of the elevator control 7 directly to the box 25. As is to be inferred from FIG. 2, the box 25 is advantageously inserted into a holder H so that it can be mounted and demounted simply and quickly.

FIG. 3 shows a schematic illustration of different sensors, the signals of which can be communicated to the input 18 of the box 25. A sensor 28 is a temperature sensor, such as the temperature sensor 10 which can be mounted in the machine room 9 or at the drive motor 6 or in the shaft door region. A sensor 29 is a current sensor which can be the current sensor 11 mounted in the elevator control 7. A sensor 30 is a microphone such as the microphone 14 shown in FIG. 1 and a sensor 31 is a camera, which are mounted at the wall of the elevator car 3. Many other types of sensors, the signals of which can be communicated to the input 18 of the box 25, can be used, for example sensors which measure distance, expansion, leveling of the elevator car, speed, shock (acceleration), vibrations, jolting, moment, pressure, force, light quantity, brightness, filling state, density, magnetic field, moisture, smoke, exhaust gases, taste, odor and/or a conductivity. As is evident from FIG. 3, the sensors are advantageously inserted in a mount M so that they can be mounted and demounted simply and quickly.

Further sensors or detectors for explosives, vandalism and cable monitoring can be connected with the device 17, which thus can also exercise the function of safety equipment. The communication of a combination of measurement values to the device 17 is also possible.

Numerous external apparatus can be connected with the device 17, such as cameras, microphones, automatic systems for access control, identification and allocation of elevators (for example, the "Schindler ID" system) or automatic systems for safety monitoring of a elevator installation (for example, the Schindler "Qualison" system). "Schindler ID" and "Qualison" are trademarks of Schindler Aufzuge AG of Ebikon, Switzerland and the systems are available from Schindler Elevator Corporation of Morristown, N.J.

Examples of remote monitoring functions able to be undertaken by the device 17 are: triggering of test travels and learning travels, journey numbers, number of door openings, report of an open door, remote alarm, disturbance reports, remote control of specific elevator functions, statements with respect to the state of the elevator, the state of the door, the state of specific relays, elevator position, travel direction, remote action on the elevator state and elevator data, checking of access authorization, statistical analysis of traffic, checking the state of the supporting cables, accuracy of stopping, checking of the elevator car by a camera, temperature sensors, for example for the drive motor, the car or the elevator shaft, smoke detectors, remote diagnosis and remote repair, by reset of the elevator control, for example measuring and evaluation of vibrations, measurements of voltage, current, brightness, lighting, temperature, position of the car, direct action on specific relay outputs, for example switching on a fan.

The device 17 can also actuate automatic flashing lights in the elevator installation, compose and display indications and text and activate signaling elements.

This list is not exhaustive. With knowledge of the present invention the elevator expert can put forward and introduce still further remote maintenance functions. Further uses of the device 17 are described below.

Figure 4:
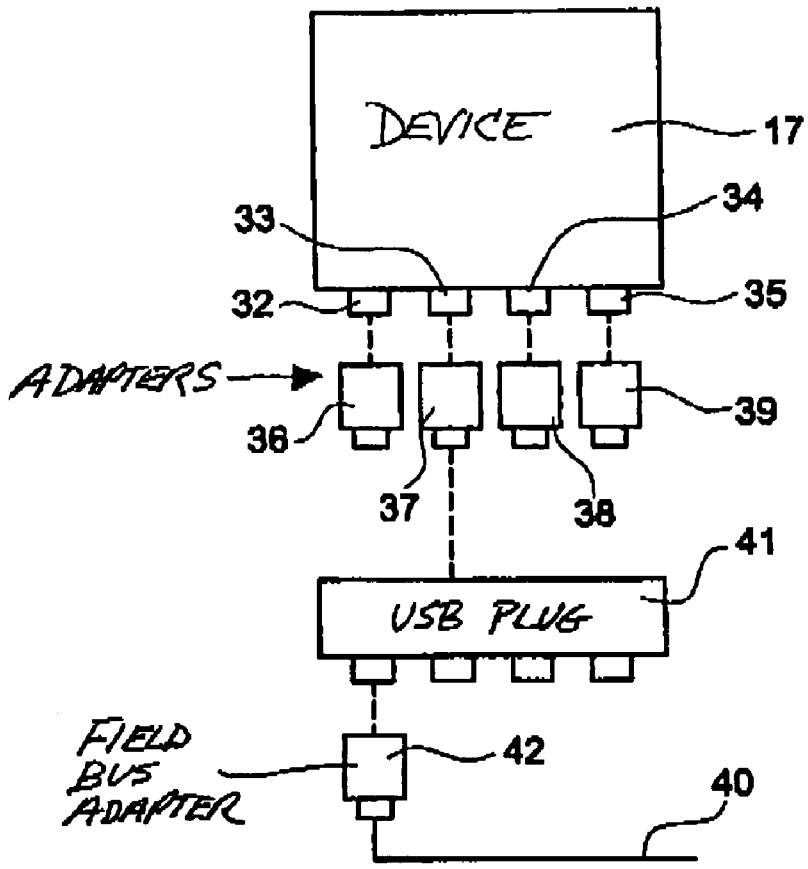
FIG. 4 is a schematic block diagram of a configuration of USB plugs and adapters, which are connected with the device according to the present invention.

FIG. 4 shows a block diagram of a possible configuration of USB plugs, which can be connected with a device according to the present invention. The following includes an explanation as to how a remote maintenance function is activated.

To begin, the device 17 has four plugs USB (Universal Serial Bus) 32 to 35. The USB plug 32 is connected with a serial adapter 36 that receives the signals of the elevator control 7. The communications protocol is, for example, RS232 (Recommended Standard 232). The USB plug 33 is connected with a hub adapter 37 (traffic nodal point). The USB plug 34 is connected with a network adapter 38 that is provided for the communications protocol of Ethernet. The USB plug 35 is connected with a modem adapter 39, which looks after connection with the telecommunications network. Possible communications networks are:

PSTN (Public Switched Telephone Network), ISDN (Integrated Service Digital Network), GSM (Global System for Mobile communications), and DSL (Digital Subscriber Line).

We now assume that the elevator installation 1 (FIG. 1) requires, for example, a remote maintenance function "measurement of the brightness of the car". The activation of this new function is carried out through use of hardware and/or software means. A brightness sensor obviously has to be installed in the elevator car 3 (FIG. 1) and connected by a brightness sensor cable 40 with the device 17. The interface with the device 17 is executed as follows:

An additional USB plug 41 with, for example, four USB outputs is connected with the hub adapter 37 (traffic nodal point).

A field bus adapter 42 is connected with one of the USB outputs of the additional USB plug 41 in order to be able to communicate the signal of the brightness sensor cable 40 to the device 17 by a protocol.

The three other USB outputs of the additional USB plug 41 remain available for signals of further sensors (not shown) which can be introduced.

A software program containing the control of the new remote maintenance function "measurement of the brightness of the elevator car" is then loaded into the data memory of the device 17. The loading of the software can be carried out by the telecommunications network 16 or directly by a local connection with a remote maintenance PC. If a program containing a set of remote maintenance functions, in which the remote maintenance function "measurement of the brightness of the elevator car" is already provided, is already stored in the data memory of the device 17, activation of the remote maintenance function, for example by selection of this function in a software menu, is sufficient for loading the software for the new remote maintenance function into the processor and making it ready. The activated remote maintenance function "measurement of the brightness of the elevator car" evaluates first signals, which can be, for example, electrical voltages proportional to brightness, and issues corresponding second signals, which can be, for example, a number (1 to 10) or a digital word ("bright" or "dark").

Through use of the additional USB plug 41 in the device 17 and activation of the corresponding remote maintenance function "measurement of the brightness of the elevator car" in the software program the remote maintenance system is made capable in a quick, economic and simple manner to also remotely monitor the brightness of the elevator car. This flexibility and rapidity in configuration of the remote maintenance functions offered by the device 17 do not have any precedent in the state of the art.

Figure 5:
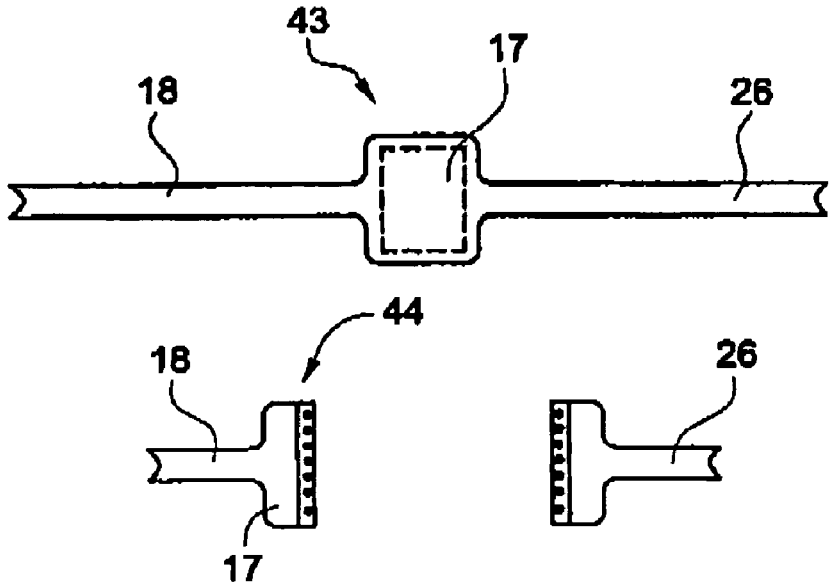
FIG. 5 is a plan view second and third embodiments of the device according to the present invention in the form of an intelligent cable and an intelligent plug.

The device 17 can, for example, have the appearance of a case or a box, as shown in FIG. 2; it can be positioned as desired, for example in the machine room 9 in a switch cabinet, at the switch cabinet, at the floor, at the wall or in the elevator control 7. The device 17 can, however, also have the form of an intelligent plug or intelligent cable, which can completely or partly dissimulate and conceal its remote maintenance functions and its circuits. An intelligent cable or intelligent plug can thus be achieved which enables remote maintenance of the elevator installation secure against adulteration: only authorized and competent engineers recognize the presence of the device 17 and can switch on or switch off the remote maintenance functions. FIG. 5 shows a possible aesthetic design of the device 17 according to the invention, which appears in the form of an intelligent cable 43 or intelligent plug 44. In this case the device 17 is combined with the system of cables with which it is connected and which can also be disposed outside the elevator installation 1. The box 25 (FIG. 2) and/or the cables 43 and/or the plugs 44 are advantageously interchangeably connected with the elevator installation 1 and can be exchanged simply and quickly in a practical manner.

Figure 6:
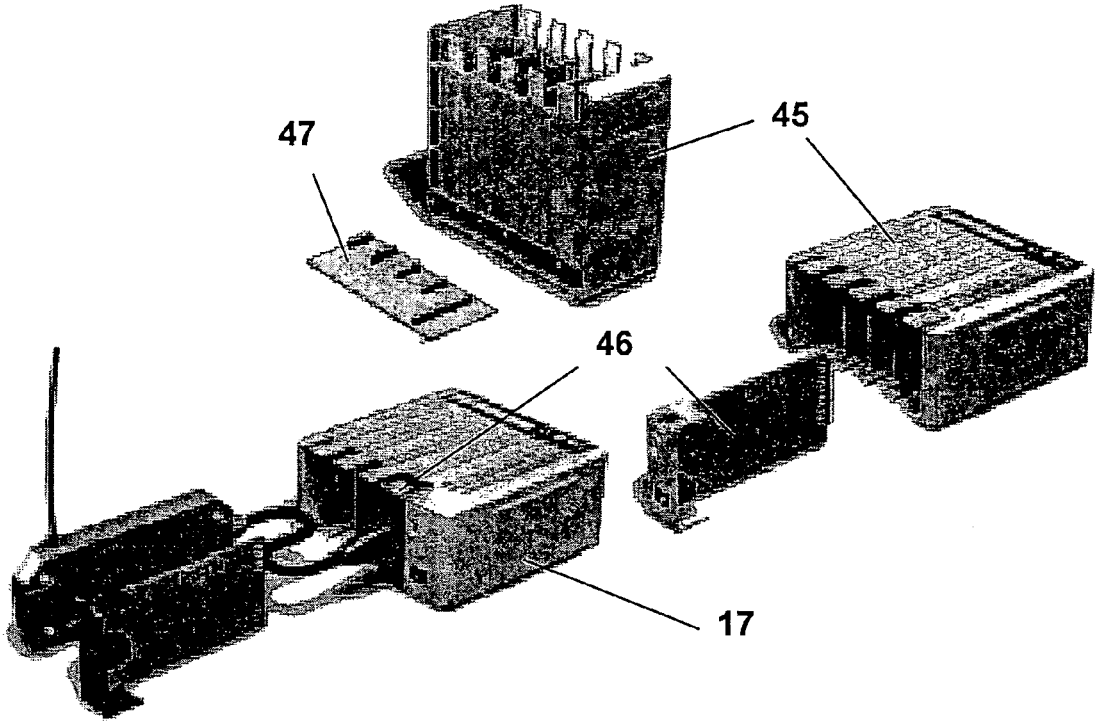
FIG. 6 is an exploded perspective view of the device according to the present invention.

FIG. 6 is an exploded illustration of a modular form third embodiment of the device 17. A plug frame 45 acts as cover. The processor (CPU, Central Processing Unit) and the difference serial interfaces, such as the universal serial bus (USB), the plug RS232, the modem, the Ethernet connection, the line manager telephone (LU) and the LON are constructed as separate, independent modules 46 and inserted into separate bays in the plug frame 45. Communication between these separate modules 46 is looked after by a back panel 47, which panel is also pushed into the plug frame 45 and has several plug pins in order to connect with the plugs of the modules 46. A serial communication by a bus between the modules 46, which is distinguished by being particularly flexible and free in configuration, is achieved by the back panel 47. At the same time, the current supply by means of separate contacts is integrated in the plug strip.

The modular construction of the device 17 shown in FIG. 6 is also very practical. The modules 46 can be pushed in and pushed out individually as desired without the functionality of the device 17 being impaired and without operations for a new configuration of the device 17 having to be undertaken.

Preferably, the device 17 shown in FIG. 6 is placed in a thick, soft removable rubber housing (not shown), which can be easily assembled and is drip-proof. The rubber housing creates a protection against impacts and moisture and is aesthetically agreeable. The rubber housing can be realized in different protective embodiments depending on the respective operational and environmental demands.

Advantageously, a data detection of the device 17 is synchronized with the elevator travel. The detection of measurement data is in that case controlled by the individual sequences of an elevator travel. This means that the pick up of data can be made dependent on well-determined situations and conditions. Thus, for example, vibration measurements at the drive unit can be undertaken with quite specific load conditions.

In addition, an automatic detection of data is advantageously provided. Measurement data are picked up according to predefined criteria, combined into data blocks and communicated to an outside point according to predetermined rules. Thus, for example, door opening times can be monitored in that the associated measurement values are regularly detected, on reaching a specific data quantity a compression of the same is undertaken and the resulting data are delivered to an outside point for further processing.

A special application can be represented by vibro-acoustical measurements. The drive unit is equipped with a sensor for detection of vibrations, for example an acceleration pick-up, whereby an analysis of the dynamic sequences can be carried out. This enables diagnosis of bearing damage, transmission damage, imbalance and wear effecting the drive unit. The measuring unit can be mounted, in the case of traction elevators, at the drive unit 6, and in the case of a hydraulic drive at the pump.

The maintenance instructions can also be communicated by the device 17. Depending on the actual state and operational readiness of an elevator the instructions necessary for maintenance and/or repair are delivered from an external point to the remote maintenance unit at the elevator installation. The technician arriving at the installation can then view these with the help of a data display apparatus and execute the necessary work without delay. Execution of the instructions can be confirmed by the technician and subsequently automatically communicated to the outside point. The delivery of maintenance instructions can also be generated as a direct consequence of a disturbance report.

Advantageously the routine communication of measurement data to an outside point is carried out to be so arranged in terms of time that minimum costs for the connection arise. For that purpose the actually applicable tariffs are communicated to the remote maintenance unit or called up by this and planning of the transfer undertaken with consideration of any applicable priorities and delivery times, which are to be maintained, of communications. The transmission is then carried out in correspondence with this plan.

The device 17 can initiate, for example, stress tests, i.e. automatic loading of a elevator installation with travel orders for ascertaining the robustness, availability and performance capability thereof. For this purpose travel requirements are generated by a remote maintenance unit, communicated to the installation by floor and car calls and the processing of these calls registered. The result of such a test can be communicated to an outside point for further processing.

The device 17 can also initiate, for example, automatic tests. The acknowledgement of a disturbance report automatically has the consequence of triggering a corresponding test sequence for checking for the elimination of the disturbance. The mode and manner of the test performed can, for example, be made dependent on the content of the associated disturbance report.

Test marks can be used in this connection. In the case of detection of a disturbance a mark is generated and communicated, together with the associated disturbance report, to an external point. With the help of these marks specific test functions are accessible as a consequence, which functions are no longer available after elimination of the disturbance. This can concern, for example, remote triggering of a test travel by means of an analog telephone connection and DTMF-coded key data. The validity of a mark can also expire on use thereof.

The device 17 can in certain circumstances carry out a checking of the external point. The functional capability of an external point is checked by the requirement of an authentication feature and modifies specific functions in correspondence with the output of this test. Thus, the functional scope can perhaps be restricted, settings reparameterized or availability reduced.

The elevator parameters can also be constantly adapted by the device 17. Data occurring during operation are collected and communicated to the center 20 for evaluation. This is carried out in the manner that with observation of data of other installations a setting is derived which is favorable to a certain extent. This setting is automatically communicated to the corresponding installation for further operation. In a concrete embodiment statements relative to the failure of an installation can perhaps be used for the purpose of achieving a test strategy which is optimal with respect to statistical magnitudes. For this purpose, all failures are detected in installation-specific manner, parameters for description of the failure probability of each installation are ascertained in the center, and these parameters are then communicated to the installation for adaptation of the test strategy.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A device for remote maintenance and monitoring of an elevator installation comprising:

at least one input for detection of first signals from at least one of an elevator control and a sensor associated with the elevator installation;

at least one output of second signals to a telecommunications network; and a processor and a data memory connected to said at least one input and said at least one output and having a set of remote maintenance functions stored in said data memory, said remote maintenance functions including at least one of monitoring of stress measurements in an elevator car, temperature monitoring, and activation of a camera, at least one of said remote maintenance functions being selectively activatable, said at least one input, said at least one output, said processor and said data memory being installed at the elevator installation.

2. The device according to claim 1 wherein said at least one remote maintenance function configures hardware and software of said device and said at least one remote maintenance function is activatable by loading from said data memory into said processor.

3. The device according to claim 1 wherein said at least one remote maintenance function when activated evaluates said first signals and issues said second signals corresponding with a result of the evaluation.

4. The device according to claim 1 wherein a sensor for sensing one of temperature, current, voltage, audio, video, spacing, expansion, leveling, speed, shock, acceleration, vibrations, jolting, moment, pressure, force, light quantity, brightness, filling state, density, magnetic field, moisture, smoke, exhaust gas, taste, odor and conductivity.

5. The device according to claim 1 including an I/O box connected as an interface between said processor and the elevator installation for converting parallel signals from the elevator control and sensors into serial signals.

6. The device according to claim 5 wherein said I/O box includes one of a plurality of modular interfaces adapted to different proprietary elevator installations, each of said modular interfaces adapted to communicate standardized signals to said processor so that these elevator installations are operable with said set of remote maintenance functions.

7. The device according to claim 1 wherein said device automatically configures itself and/or self-learns by a learning travel with respect to which of a plurality of inputs correspond with which of said first signals.

8. The device according claim 1 wherein said device is positioned in one of a box, an intelligent cable and an intelligent plug.

9. The device according to claim 8 wherein said box, said intelligent cable and said intelligent plug are adapted to be exchangeably connected with the elevator installation.

10. The device according to claim 1 including a plug frame having a plurality of bays, a different module retained in each of said bays, one of said modules including said processor, and back panel inserted into said plug frame and providing serial communication between said modules.

11. The device according to claim 1 including at least one external apparatus connected with said device, said external apparatus being one of a camera, microphone, automatic system for access control, identification and allocation of elevator cars and an automatic system for safety monitoring of the elevator installation.

12. A method for remote maintenance and monitoring of an elevator installation comprising the steps of:

a) storing a set of remote maintenance functions in a device at the elevator installation;

b) selectively activating a remote maintenance function of the set;

c) detecting a first signal from an elevator control and/or from a sensor associated with the elevator installation and being related to the activated remote maintenance function; and d) communicating a second signal to a telecommunications network in response to the first signal.

13. The method according to claim 12 including a step of adding at least one remote maintenance function to the set or removing at least one remote maintenance function from the set.

14. The method according to claim 13 wherein said step of adding or removing is performed by transferring the at least one remote maintenance function by a telecommunications network.

15. The method according to claim 12 including performing said step b) without operational interruption of the elevator installation or another of the remote maintenance functions which is not affected by the activation.

16. The method according to claim 12 wherein the remote maintenance functions are each related to at least one of learning travels, test travels, journey numbers, numbers of door openings, open door, remote alarm, disturbance reports, remote control of specific elevator functions, adaptation of elevator parameters, a state of the elevator, a state of the door, a state of specific relays, elevator position, travel direction, remote action on the elevator state and elevator data, access authority, statistical analysis of traffic, state of the supporting cables, stopping accuracy, a camera, temperature sensors, smoke detectors, remote diagnosis, remote repair, reset of the elevator control, maintenance instructions, checking of an external point, measurement and evaluation of vibrations, voltage, current, brightness, lighting, temperature, position of the car, and direct action on specific relay outputs.

17. The method according to claim 12 including a step of communicating the second signal to a service center which regulates operation of the elevator installation and monitors and records the maintenance state of the elevator installation.

18. The method according to claim 12 wherein said step c) is synchronized with travel of an elevator car of the elevator installation.

19. The method according to claim 12 including performing said step c) automatically at regular intervals.

20. The method according to claim 12 including performing said step c) by converting the first signal to a standard form with an interface and performing said step d) in response to the first signal in the standard form.

* * * * *